US006073533A

United States Patent [19]

Brandon

[11] Patent Number: 6,073,533

[45] Date of Patent: Jun. 13, 2000

[54] SHOT CADDY

[76] Inventor: Jerry R. Brandon, 2717 Edison St., #23, Klamath Falls, Oreg. 97603

[21] Appl. No.: 08/941,853

[22] Filed: Sep. 30, 1997

Related U.S. Application Data

[60] Provisional application No. 60/027,969, Oct. 8, 1996.

[51] Int. Cl.[7] ..... F42B 33/00

[52] U.S. Cl. ..... 86/45; 86/20.1; 86/31; 222/181.3; 222/184; 222/462; 222/561

[58] Field of Search ..... 86/23–33, 89–41, 86/45, 42, 20.1, 20.11, 20.13, 21; 42/87, 88, 90; 222/181.1, 181.2, 181.3, 185.1, 184, 462, 559, 561

[56] References Cited

U.S. PATENT DOCUMENTS

| | | | |
|---|---|---|---|
| 853,427 | 5/1907 | Stoewsand | 222/184 |
| 1,485,032 | 2/1924 | Janes | 222/561 |
| 3,465,924 | 9/1969 | Michaels | 222/561 |
| 3,771,411 | 11/1973 | Hazel | 86/27 |
| 3,796,127 | 3/1974 | Deitemeyer | 86/30 |
| 3,814,294 | 6/1974 | Stevenson | 222/561 |
| 4,020,737 | 5/1977 | Ranson | 86/23 |
| 4,158,321 | 6/1979 | Meacham | 86/45 |
| 4,186,646 | 2/1980 | Martin | 86/29 |
| 4,289,258 | 9/1981 | Ransom | 222/308 |
| 4,292,877 | 10/1981 | Lee | 86/31 |
| 4,418,606 | 12/1983 | Lee | 86/31 |
| 4,455,915 | 6/1984 | Ransom | 86/46 |
| 4,475,435 | 10/1984 | Mantel | 86/26 |
| 4,620,472 | 11/1986 | Dillon | 86/27 |
| 4,632,008 | 12/1986 | Horner | 86/24 |
| 4,651,619 | 3/1987 | Voecks | 86/44 |
| 4,856,681 | 8/1989 | Murray | 222/181.2 |
| 5,040,449 | 8/1991 | Lee | 86/27 |
| 5,248,067 | 9/1993 | Garcia | 222/561 |
| 5,335,578 | 8/1994 | Lorden et al. | 86/45 |
| 5,425,483 | 6/1995 | Mertes | 222/561 |

FOREIGN PATENT DOCUMENTS

| | | | |
|---|---|---|---|
| 329693 | 2/1903 | France | 86/31 |
| 579486 | 9/1976 | Switzerland | 222/561 |
| 611410 | 10/1948 | United Kingdom | 222/561 |

*Primary Examiner*—Harold J. Tudor
*Attorney, Agent, or Firm*—Rick Martin

[57] ABSTRACT

The present invention is a shot caddy having a cover and a slide valve. Shot is stored in the cylindrical housing until it is needed. The slide valve is opened by the user thereby allowing shot to flow in a controlled manner into another container. A baffle is contained within the cylindrical housing to meter the flow of shot. The shot caddy may be mounted on a wall with a key mounted on the cylindrical housing.

16 Claims, 3 Drawing Sheets

SHOT CADDY

CROSS-REFERENCE TO RELATED APPLICATIONS

This application claims the benefit of U.S. Provisional Application no. 60/027,969 filed Oct. 8, 1996.

FIELD OF INVENTION

The present invention relates to containers or caddys used to assist shooting enthusiasts in storing shot for reloading shotgun shells in an efficient and time-saving manner.

BACKGROUND OF THE INVENTION

Prior devices have afforded the shooter the ability to reload shotgun shells by combining the powder, shot, casing, and primer in a single mechanical device. However, in order to store the shot, it is necessary to maintain it in small bottles which the enthusiast purchases from his local retailer. No means is currently available to store shot in a bulk way while affording easy dispensing of the shot for use in reloading shotgun shells.

Representative of the art is:

U.S. Pat. No. 4,020,737 (1977) to Ranson discloses a manual cartridge loading machine having six stations at which cartridges are operated on.

U.S. Pat. No. 4,158,321 (1979) to Meacham discloses a casing feeder device which attaches to a shell reloading machine.

U.S. Pat. No. 4,289,258 (1981) to Ranson discloses a sliding charge receiver which is positioned under a powder feed hopper.

U.S. Pat. No. 4,292,877 (1981) to Lee discloses an ammunition loader having hoppers for shot and/or powder and a slidable charge bar for metering shot and powder from the hoppers.

U.S. Pat. No. 4,418,606 (1983) to Lee discloses a powder measuring device for use in connection with reloading cartridges.

U.S. Pat. No. 4,455,915 (1984) to Ranson discloses a feed hopper for shell casings for use with a cartridge loading machine.

U.S. Pat. No. 4,475,435 (1984) to Mantel discloses a bullet feed assembly for a shell casing reloader.

U.S. Pat. No. 4,620,472 (1986) to Dillon discloses a shell reloading machine.

U.S. Pat. No. 4,632,008 (1986) to Horner discloses an apparatus with a slotted hopper and a gate to orient and stash primers.

U.S. Pat. No. 4,651,619 (1987) to Voecks discloses a shotgun shell dispenser having a hopper.

U.S. Pat. No. 5,040,449 (1991) to Lee discloses a shotgun shell reloader.

U.S. Pat. No. 5,335,578 (1994) to Lorden discloses a retrofitting shell feeding attachment for shotgun shell reloading machines.

None of the known prior art teaches a simple wall-mounted container for storing shot. The present invention teaches a wall-mounted container having a manually operated shutter and chute to dispense the shot.

SUMMARY OF THE INVENTION

The main aspect of the present invention is to provide a means of storing bulk shot while providing an easy way of dispensing the shot for use in reloading.

Other aspects of this invention will appear from the following description and appended claims, reference being made to the accompanying drawings forming a part of this specification wherein like reference characters designate corresponding parts in the several views.

The present invention consists of a cylinder having a removable top or cover. The cylinder base forms a hopper having a central opening. A slide valve is mounted on the central opening. When the user desires to dispense shot, he simply pulls on a ring on the slide valve, thereby opening the way for the shot to flow into another container. A baffle is installed in the interior at the base of the cylindrical housing over the central opening of the hopper to control and meter the flow of shot through the opening. The shot caddy also has a key located on the outer surface of the housing opposite the valve ring. The key mates to its receiver mounted on a wall so the shot caddy can be wall mounted for ease of use. The key allows the shot caddy to be quickly and easily removed from the wall at the discretion of the user.

Before explaining the disclosed embodiments of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
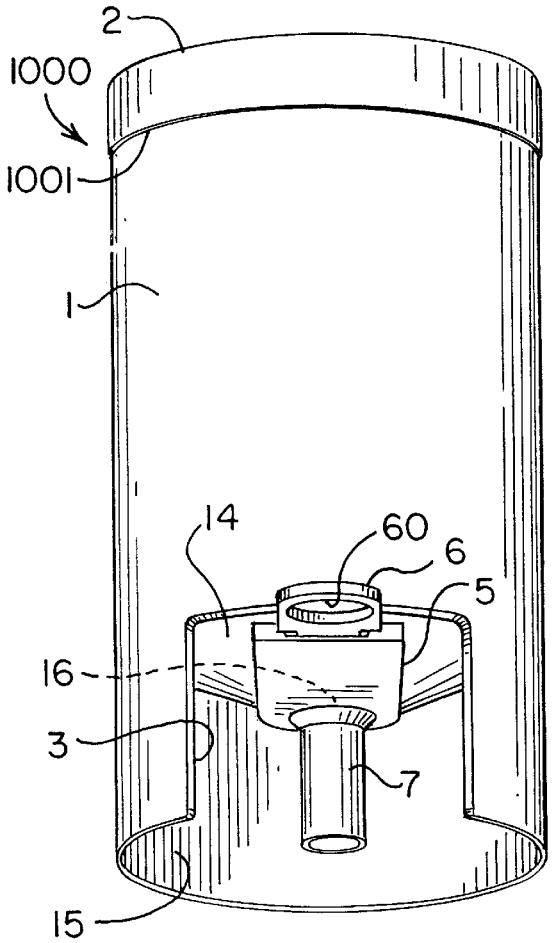
FIG. 1 is a perspective view of the preferred embodiment.

FIG. 1 is a perspective view of the preferred embodiment. The shot caddy 1000 has a cylindrical housing 1 and a cover 2 removably mounted to the top 1001 of the cylindrical housing 1. Hopper 14 is attached to the inner surface 15 of cylindrical housing 1. Hopper 14 is installed at a predetermined elevation above the bottom of cylindrical housing 1. Hole 16 in the bottom of hopper 14 is covered by slide valve housing 5. Contained within slide valve housing 5 is slide valve body 6 having finger hole 60. Connected to the side of slide valve housing 5 in alignment with hole 16 is spout 7. Access to spout 7 is afforded by lateral opening 3 of cylindrical housing 1.

Figure 2:
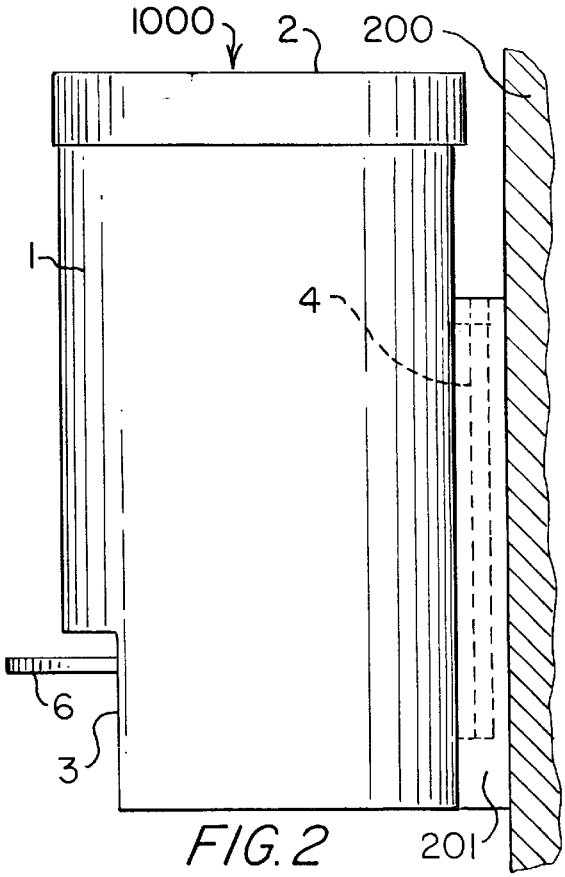
FIG. 2 is a side plan view of the preferred embodiment.

FIG. 2 shows cover 2 installed on cylindrical housing 1. The slide valve body 6 is shown in its orientation in lateral opening 3. Key 4 is attached to the outer surface of cylindrical housing 1. Wall 200 supports receiver 201 which removably supports key 4.

Figure 3:
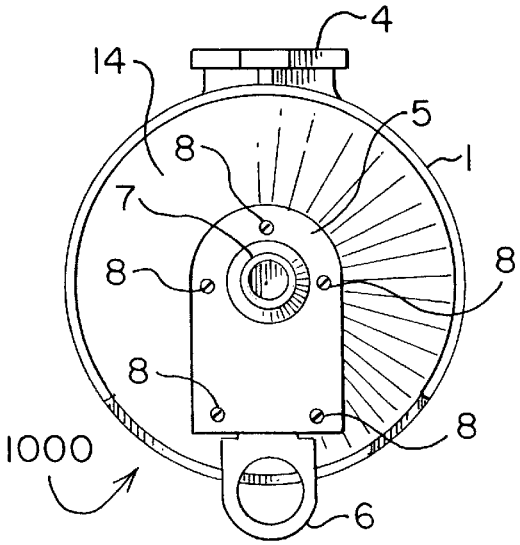
FIG. 3 is a bottom plan view of the preferred embodiment.

FIG. 3 depicts key 4 mounted to cylindrical housing 1. Slide valve housing 5 mounts around slide valve body 6 via screws 8. Spout 7 is connected to slide valve housing 5.

Figure 4:
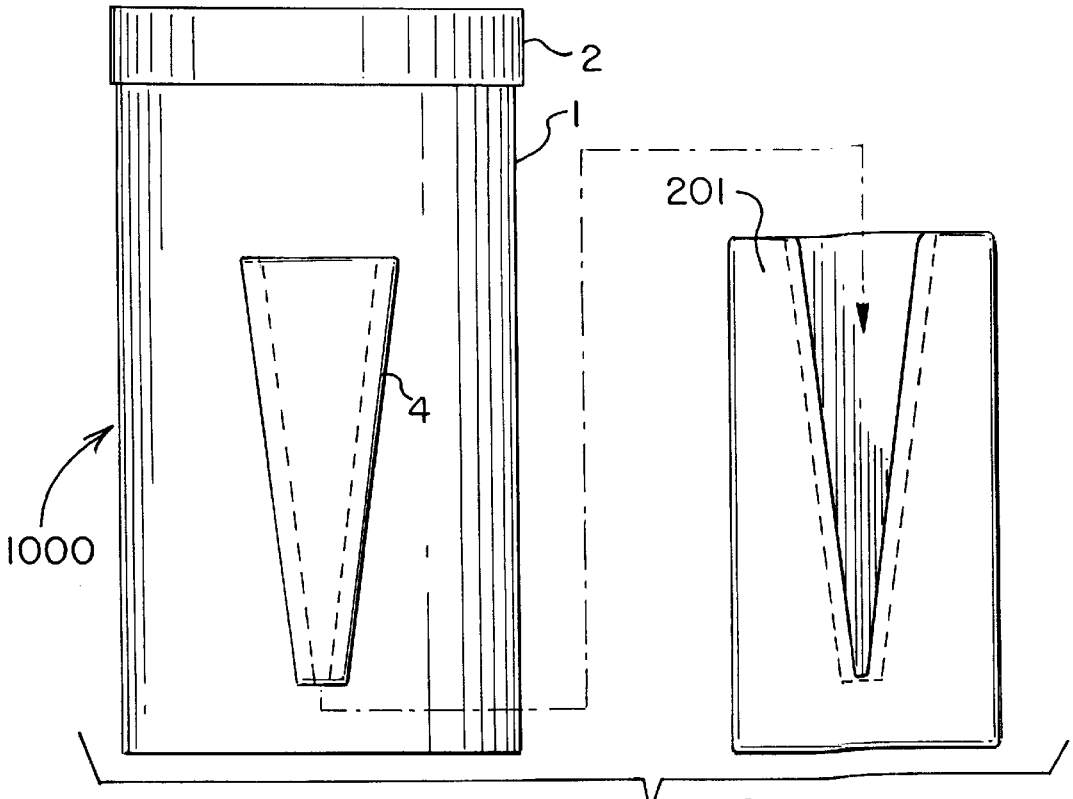
FIG. 4 is a back plan view of the preferred embodiment.

FIG. 4 is a back plan view of the preferred embodiment. Key 4 is mounted to cylindrical housing 1. Cover 2 is installed on cylindrical housing 1. Receiver 201 removeably supports key 4.

Figure 5:
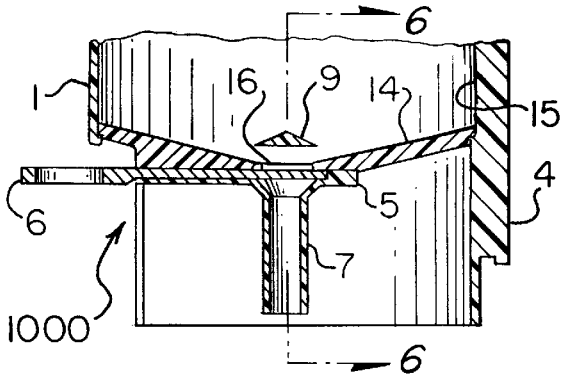
FIG. 5 is a longitudinal sectional side elevation view of the preferred embodiment.

FIG. 5 shows hopper 14 attached to inner surface 15. Attached to hopper 14 above hole 16 is baffle 9.

Figure 6:
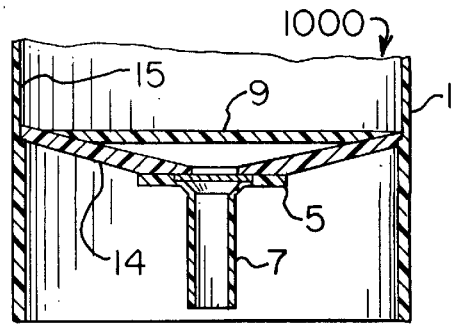
FIG. 6 is a longitudinal sectional front elevation view of the preferred embodiment taken along line 6—6 of FIG. 5.

FIG. 6 shows baffle 9 attached to hopper 14.

Figure 7:
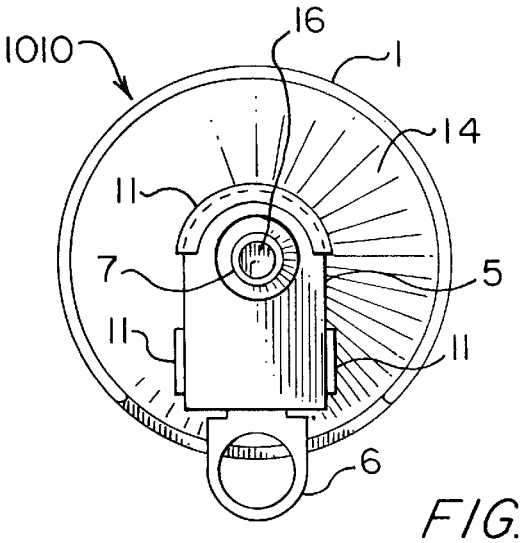
FIG. 7 is a bottom plan view of an alternate embodiment.

FIG. 7 is a bottom plan view of an alternate embodiment, shot caddy 1010. Cuff 11 engages slide valve housing 5 in a position below hole 16. Slide valve body 6 is contained within slide valve housing 5 by cuff 11.

Figure 8:
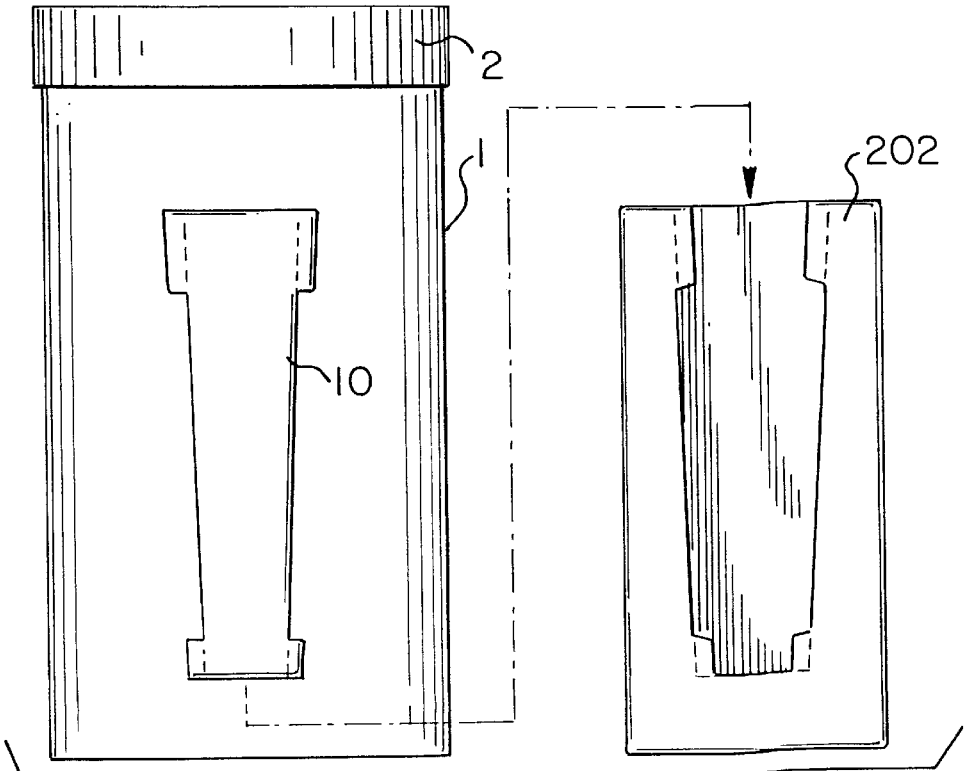
FIG. 8 is a back plan view of another alternate embodiment.

FIG. 8 is a back plan view of another alternate embodiment. Key 10 is mounted to cylindrical housing 1. Cover 2 is installed on cylindrical housing 1. Receiver 202 removably supports key 10. Receiver 202 is mounted to a wall (not shown).

Figure 9:
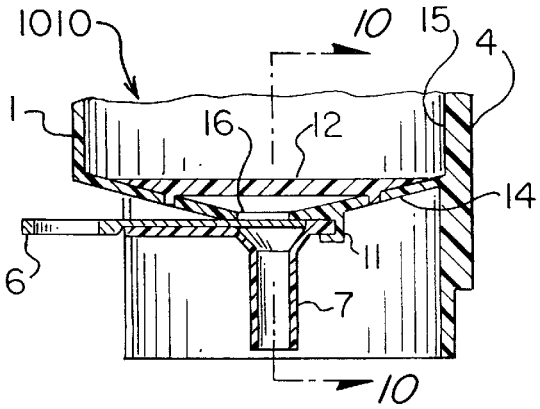
FIG. 9 is a longitudinal sectional side elevation view of an alternate embodiment.

FIG. 9 is a longitudinal sectional side elevation view of the alternate embodiment 1010. Baffle 12 is attached to hopper 14 immediately above hole 16.

Figure 10:
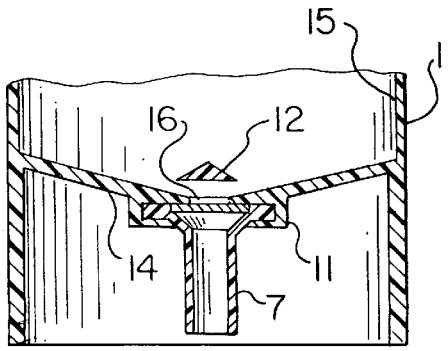
FIG. 10 is a longitudinal sectional front elevation view of an alternate embodiment taken along line 10—10 of FIG. 9.

FIG. 10 is a longitudinal sectional front elevation view of the alternate embodiment 1010. Baffle 12 is attached to hopper 14 immediately above hole 16.

The shot caddy is filled with shot by the user by removing cover 2 and closing slide valve body 6. The shot (not shown) is poured into the cylindrical housing 1 until full. To remove shot from the shot caddy, slide valve body 6 is retracted to open hole 16. The shot then flows from the shot caddy into a receptacle or container of the user's choosing.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A shot caddy comprising:

a cylindrical housing having an outer surface and bottom and top openings;

a hopper having an upper rim and an inner surface and a centerline and further describing a hole located on said centerline of said hopper;

a valve having a valve body and a valve housing, said valve body slidingly contained within said valve housing;

said valve attached to said hopper and covers said hole, whereby a bulk flow of a material may be controlled;

a baffle comprising an elongate member formed of a plurality of flat surfaces and having a triangular cross-sectional shape along a major longitudinal axis; and said baffle being attached to said inner surface of said hopper such that said baffle is normal to and bisected by said centerline of said hopper and functions to control the flow.

2. The shot caddy as in claim 1, wherein said valve further comprises:

a hole in said valve housing at one end; and said valve body having a shape substantially similar to said valve housing and slidingly contained by a cuff attached to said hopper, whereby said valve body may slidingly cover and uncover said hole in said valve housing.

3. The shot caddy as in claim 2 further comprising a cover removeably connected to said top opening of said cylinder.

4. The shot caddy as in claim 3, wherein said cuff further comprises opposing "L"-shaped edges in contact with said valve housing whereby said valve body is slidingly contained between said "L"-shaped edges.

5. The shot caddy as in claim 4 further comprising:

a key attached to said outer surface of said cylinder;

a receiver; and said receiver attached to a vertical surface whereby said key is removeably engaged to said receiver.

6. The shot caddy as in claim 5 further comprising:

a skirt attached to said bottom opening whereby said cylinder is supported on a horizontal surface; and said skirt further describing an opening whereby a user may access said valve body to allow a user to dispense a material.

7. The shot caddy as in claim 5 further comprising:

a nozzle depending from said hole in said valve housing; and said nozzle being aligned coaxially with the centerline of said hopper.

8. The shot caddy as in claim 6 further comprising:

a nozzle depending from said hole in said valve housing; and said nozzle being aligned coaxially with the centerline of said hopper.

9. A shot caddy comprising:

a cylindrical housing having an outer surface and bottom and top openings;

a hopper having an upper rim and an inner surface and a centerline and further describing a hole located on said centerline of said hopper;

a valve having a valve body and a valve housing, said valve body slidinaly contained within said valve housing;

said valve attached to said hopper and covers said hole whereby the bulk flow of a fluent material may be controlled;

a baffle comprising an elongate member formed of a plurality of flat surfaces and having a triangular cross-sectional shape along a major longitudinal axis; and said baffle being attached to said inner surface of said hopper such that said baffle is normal to and bisected by said centerline of said hopper and functions to control the flow of the fluent material.

10. The shop caddy as in claim 9, wherein said valve further comprises:

a hole in said valve housing at one end; and said valve body having a shape substantially similar to said valve housing and slidingly contained by a cuff attached to said hopper, whereby said valve body may slidingly cover and uncover said hole in said valve housing.

11. The shot caddy as in claim 10 further comprising a cover removeably connected to said top opening of said cylinder.

12. The shot caddy as in claim 11, wherein said cuff further comprises opposing "L"-shaped edges in contact with said valve housing whereby said valve body is slidingly contained between said "L"-shaped edges.

13. The shot caddy as in claim 12 further comprising:

a key attached to said outer surface of said cylinder;

a receiver; and said receiver is attached to a vertical surface whereby said key is removeably engaged to said receiver.

14. The shot caddy as in claim 12 further comprising:

a skirt attached to said bottom opening whereby said cylinder is supported on a horizontal surface; and said skirt further describing an opening whereby a user may access said valve body to allow a user to dispense a material.

15. The shot caddy as in claim 14 further comprising:

a nozzle depending from said hole in said valve housing; and said nozzle being aligned coaxially with the centerline of said hopper.

16. The shot caddy as in claim 14 further comprising:

a nozzle depending from said hole in said valve housing; and said nozzle being aligned coaxially with the centerline of said hopper.

* * * * *